US007845609B2

(12) United States Patent
Bernard

(10) Patent No.: US 7,845,609 B2
(45) Date of Patent: Dec. 7, 2010

(54) LOOP LINE

(76) Inventor: Robina B. Bernard, 295 Prince George Ct., Mississauga (CA) L4Z 1R5

( * ) Notice: Subject to any disclaimer, the term of this patent is extended or adjusted under 35 U.S.C. 154(b) by 0 days.

(21) Appl. No.: 11/798,341

(22) Filed: May 14, 2007

(65) Prior Publication Data

US 2008/0283708 A1 Nov. 20, 2008

(51) Int. Cl.
*A47G 1/00* (2006.01)

(52) U.S. Cl. ..... 248/328; 248/342; 24/122.6

(58) Field of Classification Search ..... 248/328, 248/327, 58, 61, 49, 317, 342; 24/122.6, 24/129

See application file for complete search history.

(56) References Cited

U.S. PATENT DOCUMENTS

| | | | | |
|---|---|---|---|---|
| 2,585,671 | A * | 2/1952 | Morcaldi D' | 182/196 |
| 3,030,718 | A * | 4/1962 | Kirkman | 40/617 |
| 3,188,130 | A * | 6/1965 | Pietrowicz | 294/74 |
| 4,434,570 | A * | 3/1984 | Roos | 40/617 |
| 4,519,564 | A * | 5/1985 | Nadherny | 248/58 |
| 5,277,347 | A * | 1/1994 | Savard | 224/103 |
| 5,662,295 | A * | 9/1997 | Nadherny et al. | 248/58 |
| 5,794,894 | A * | 8/1998 | Fremund | 248/53 |
| 6,076,685 | A | 6/2000 | Ramirez | |
| 6,394,873 | B1 | 5/2002 | Bernard | |
| 6,422,622 | B1 | 7/2002 | Bernard | |
| RE38,463 | E * | 3/2004 | Anderson et al. | 248/329 |
| 7,249,743 | B1 * | 7/2007 | Stearns | 248/329 |

FOREIGN PATENT DOCUMENTS

| | | |
|---|---|---|
| EP | 0 926 393 | 6/1999 |

* cited by examiner

*Primary Examiner*—Terrell Mckinnon
*Assistant Examiner*—Steven M Marsh
(74) *Attorney, Agent, or Firm*—Arne I. FORS

(57) ABSTRACT

A loop line comprised of a pair of side by side cords of equal length and knots equispaced along said cords for joining the cords together and defining loops between the knots. The cords preferably are limp monofilament with knots tied or are string or thin rope made of several strands braided, twisted or woven together and the knots for joining the cords together are formed by interlacing, braiding or looping the cords. The strands are selected from at least one of polymer, polyester or metal wire fibers. For hanging an item, the loop line has a proximal end terminating at a knot and a distal end terminating in a knot, the proximal end of the loop line is wrapped around or inserted in a hole in the item, the distal end is passed through a loop formed in the loop line at the knot at the proximal end to form a hitch attached to the item, and the loop line is hung from a knot formed in the loop line at the distal end. The system for supporting a sign or ceiling-tile rail from ceiling supports comprises a plurality of loop lines, in which a lower proximal end of the loop line can be inserted through an opening in a sign or ceiling-tile rail to be suspended, the upper distal end passed through a loop formed at the lower proximal end of the length to form a hitch attached to the sign or ceiling-tile rail, and the upper distal end of the loop line of an equivalent number of loops can be attached to the ceiling support.

8 Claims, 2 Drawing Sheets

FIG. 1.
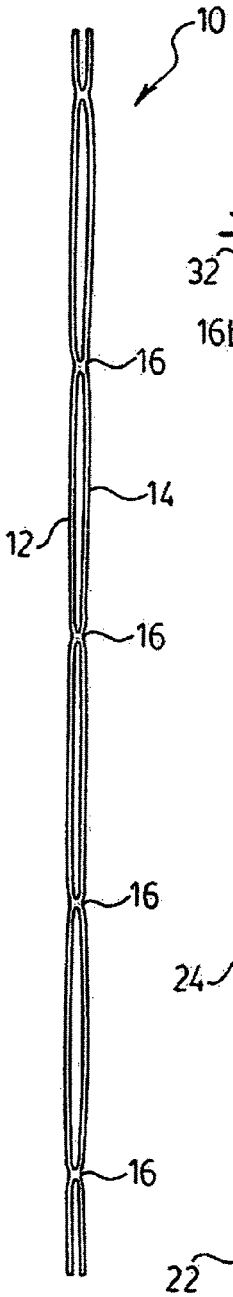
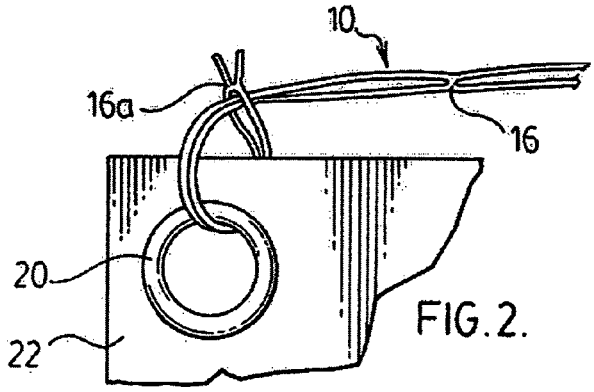
FIG. 2.
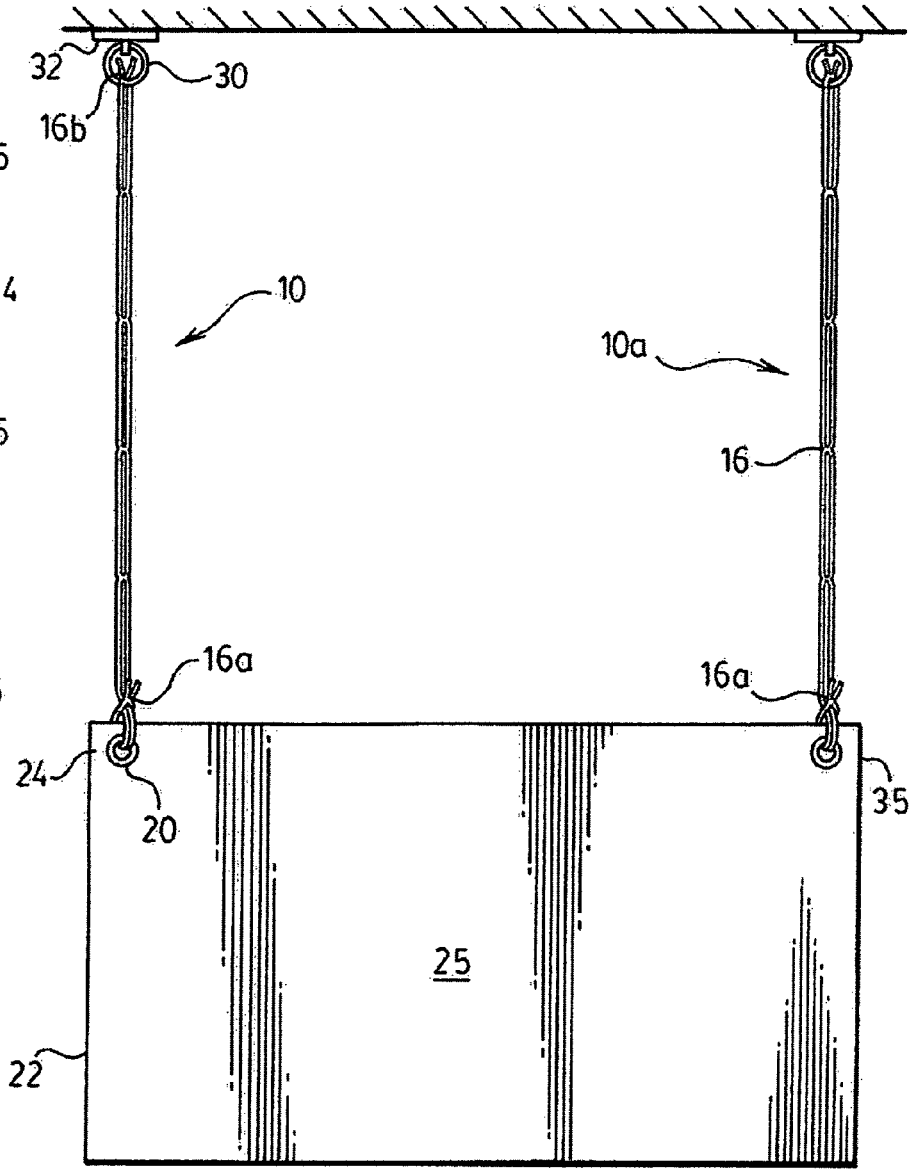
FIG. 3.

LOOP LINE

BACKGROUND OF THE INVENTION (i) Field of the Invention

This invention relates to a suspension device and, more particularly, relates to a suspension device system and to a method for suspending articles, signs and ceiling-tile rails.

(ii) Description of the Related Art

The suspension of signs and banners at opposite upper corners of signs and banners along their length from ceilings such as the ceilings of conference centres can be difficult because of the considerable height of the ceilings, and because of the problems of measurement and tying of equal lengths of cords to ceiling attachment devices.

U.S. Pat. No. 6,394,873 issued May 28, 2002 describes a ceiling suspension device including a magnet anchor having a steel split ring for suspension of a rod by a string or wire.

U.S. Pat. No. 6,422,622 issued Jul. 23, 2002 describes an installation and removal device for installing and removing magnet anchors from magnetic ceiling structures such as ceiling-tile rails for the support of a ceiling sign by rings carried by the magnet anchors.

There has been and continuous to be a need for a system and device for quick and facile attachment of signs from ceilings, particularly high ceiling which will result in level suspension of the signs. It is known to use a pair of loop-end cables made of galvanized steel cable cut to length and crimped at opposite ends, requiring clamping pliers operating by professional crimpers. Adjustable cable locks are also used to permit adjustment of the cable lengths for level hanging of signs at desired heights. Such devices are expensive and required considerable installation time.

The use of limp monofilament for knot tying and soft stainless steel wire or braided picture wire for twist tying are also known. Not only is knot tying time consuming, but it is also difficult to measure and to accurately tie knots or twist wires for equal lengths of a pair of suspension strings or wires to achieve a level sign.

Banner and sign hanging by means of 1/16" diameter steel cables with adjustable cable grippers is known. These complex mechanical devices permit cable length adjustment, but are expensive.

Double hook wire devices are commonly used to hang signs straight and level. However, such devices are limited in length and have to be used in multiple, or adjusted to length by screw clamps. Beaded, jack or plastic chains in combination with links or "S" hooks can be used to adjustably hang signs. However, S hooks can be easily dislodged.

All of the foregoing devices often require installation by skilled technicians, are expensive, and may require the use of specialized tools in an effort to hang signs or banners level.

SUMMARY OF THE INVENTION

In its broad aspect, the suspension device of the invention comprises a loop line including a pair of side by side cords of equal length and knots equispaced along said cords for joining the cords together and defining loops between the knots. The cords are limp monofilament with knots tied or are string or thin rope made of several strands braided, twisted or woven together and the knots for joining the cords together are formed by interlacing, braiding or looping the cords. The strands are selected from at least one of polymer, polyester or metal wire fibers.

In another aspect of the inventors, for hanging an item, the loop line has a proximal end terminating at a knot and a distal end terminating in a knot, the proximal end of the loop line is wrapped around or inserted in a hole in the item, the distal end is passed through a loop formed in the loop line at the knot at the proximal end to form a hitch attached to the item, and the loop line is hung from a knot formed in the loop line at the distal end.

The system the invention for supporting a sign or ceiling-tile rail from ceiling supports comprises a plurality of loop lines, each loop line comprising a pair of side by side cords joined together by knots at equal intervals along their length to form a plurality of equispaced loops along the length, said loop line having a lower proximal end and an upper distal end, whereby the lower proximal end of the loop line can be inserted through an opening in a sign or ceiling-tile rail to be suspended, and the upper distal end passed through a loop formed at the lower proximal end of the length to form a hitch attached to the sign or ceiling-tile rail, and the upper distal end of the loop line of an equivalent number of loops can be attached to the ceiling support.

The method of the invention for supporting a sign or rail by at least two sets of loop lines, each loop line comprising a pair of side by side cords join together by knots at equal intervals along their length to form a plurality of equispaced knots defining equispaced loops along their length, said loop lines having a lower proximal end and an upper distal end, comprising inserting the lower proximal end of the loop line through a sign opening, passing the distal end of the loop line through a loop at the lower proximal end to form a hitch attached to the sign, and attaching a loop at the upper distal end of the loop line at an equal number of knots counted from the lower distal ends to ceiling attachment means, whereby the sign hangs level.

BRIEF DESCRIPTION OF THE DRAWINGS

The system and device of the invention will now be described with reference to the accompanying drawings, in which:

FIG. 1 is a plan view of the loop line of the invention;

FIG. 2 is a front elevational view, partly cut away, showing installation of a loop line through a grommet in an upper corner of a sign;

FIG. 3 is a front elevational view of a sign suspended by a pair of loop lines from ceiling attachment means;

DESCRIPTION OF THE PREFERRED EMBODIMENTS

Figure 4:
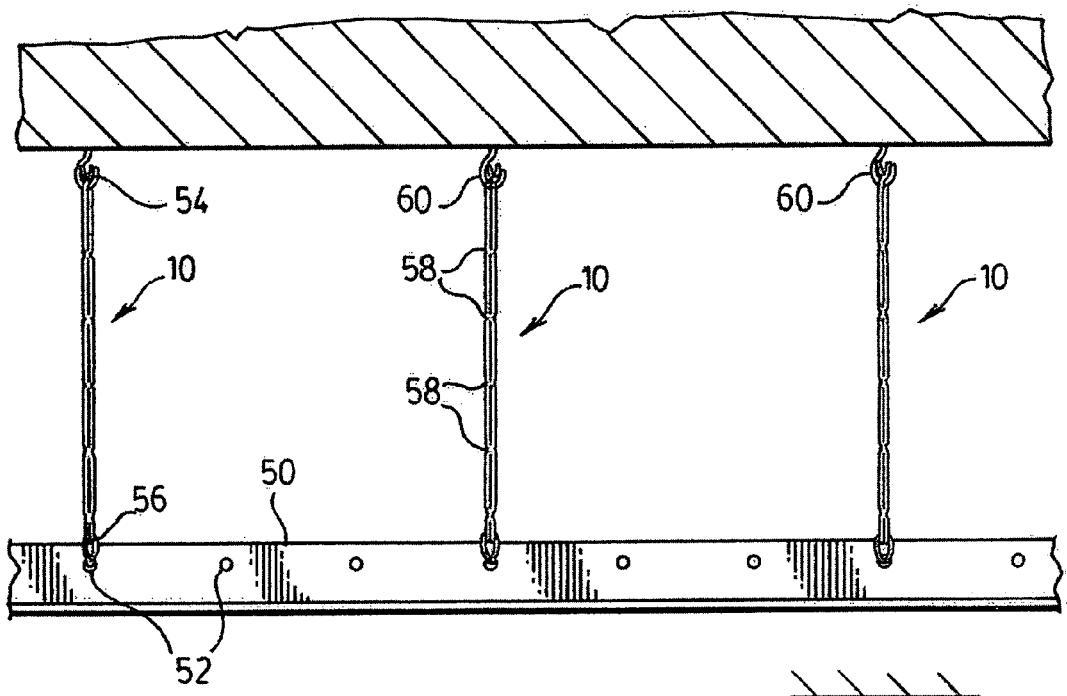
FIG. 4 is a front elevational view of a ceiling rail for a false ceiling suspended by a plurality of loop lines of equal length from ceiling attachment means.

The loop line or string ladder 10 illustrated in FIG. 1 comprises a pair of strings or cords 12, 14 joined at equal intervals by knots 16. Each of cords 12, 14 is a limp monofilament or is braided, twisted or woven preferably by braiding from a polymer fibre such as polyester fibers. It may be desired, for increase of tensile strength, to incorporate metal fibers such as thin stainless steel fibers into the braided, twisted or woven construction. The cords 12, 14 are joined together at equal intervals along the in length by knots 16, as part of the braiding or weaving process, to form a string of loops. Alternatively, the cords can be tied to form equispaced knots 16.

For reasons which will become apparent as the description proceeds, knots 16 should be braided, woven or tied in a manner whereby the knots are upset from and stand out from the loop line such that the knots can be easily felt by the user during installation and use of the loop line.

With reference to FIG. 2, the lower proximal end of loop line 10 terminating at knot 16$^a$ is inserted through grommet 20 formed in a corner of sign 22 and the distal end of string ladder 10 passed through the loop formed between knot 16$^a$ and the adjacent knot 16 and drawn tight to form a "hitch". A hitch is desirable in that it is easily formed to secure itself and can be readily removed for re-use by retracting the line through the loop.

With reference now to FIG. 3, a first loop line 10 is attached to corner 24 of sign 25 through grommet 20 in by a hitch the manner illustrated in FIG. 2. A loop 26 at the upper distal end of string ladder 10 formed by upper knot 16$^b$ is attached to ceiling support or attachment means such as a split ring 30 connected to a magnet anchor 32 such as described in U.S. Pat. No. 6,394,873 and No. 6,422,622, incorporated herein by reference. A second loop line 10$^a$ is attached to an opposite corner 35 of sign 25 and a number of knots 16 equal to the number of knots in loop line 10 counted from lower proximal end knot 16$^a$ to distal end knot 16$^b$ for attachment of split ring 30 of magnet anchor 32 to the loop 26 formed by knot 16$^b$. By counting an equal number of knots or loops usually or by feel, the two loop lines from knot 16$^a$ to knot 16$^b$ are the same length and, since it is not necessary to tie knots, the sign hangs level.

The sign can then be easily installed by lifting the magnet anchors 32 by means of the installation pole described in U.S. Pat. No. 6,422,622.

FIG. 4 illustrates a ceiling-tile rail 50 attached level to a ceiling for installation of a drop ceiling. A plurality of loop lines 10 are passed through spaced-apart holes 52 in rail 50 and the distal ends 54 passed through loops 56 at the proximal end, as described with reference to FIGS. 2 and 3. An equal number of knots 58 are counted to a loop at the distal end 54 of each line for hanging of the loop on a securing means such as a ceiling hook 60. Since no knots need to be tied, the rails will hang level.

Figure 5:
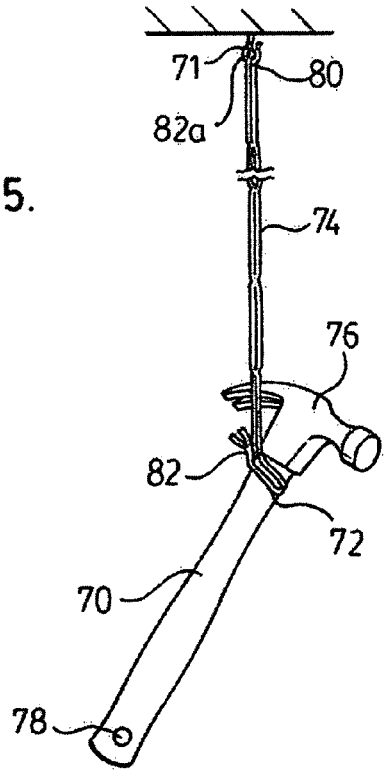
FIG. 5 is a front elevational view of a tool suspended from a hook by a loop line.

FIG. 5 shows a hammer 70 exemplary of a tool, hung from a hook 71 on a wall or ceiling. The proximal end 72 of the loop line 74 having a plurality of equispaced knots 82 is wrapped around the hammer head 76, or through a hole 78 in the handle, and the distal end 80 passed through the loop formed by knot 82 at the proximal end of the line to secure the hammer by a hitch. The loop line is hung on a loop at the opposite distal end formed by knot 82$^a$.

It will be understood that other embodiments and examples of the invention will be readily apparent to a person skilled in the art, the scope and purview of the invention being defined in the appended claims.

The invention claimed is:

1. A system for suspending a sign or ceiling-tile rail level from ceiling supports comprising a sign or ceiling-tile rail having a side edge and at least a pair of spaced-apart openings formed in the sign or ceiling-tile rail equidistant from said edge, and a pair of loop lines, each loop line comprising a pair of side by side cords comprised of monofilament, string, or thin rope made of several braided, twisted or woven strands, joined together by knots at equal intervals along their length to form a plurality of equispaced loops of equal length separated by the knots along the length of both loop lines from a lower proximal end to an upper distal end, said knots for joining the cords together upset from the loops whereby a user can feel the knots for counting the knots and loops, whereby the lower proximal end of one of the loop lines is insert$_e$d through one of the openings in the sign or ceiling-tile rail to be suspended, and the upper distal end passed through a loop formed at the lower proximal end of the length to form a hitch attached to the sign or ceiling-tile rail, and the upper distal end of each loop line at an equivalent number of equal loops can be attached to a ceiling support, whereby the sign or ceiling-tile rail hangs level.

2. A system as claimed in claim 1, in which the strands are at least one of polymer, polyester or metal wire fibres.

3. A system as claimed in claim 2, in which the ceiling supports are magnet anchors each having a split ring for receiving the loop line.

4. A method for supporting a sign or rail level by at least two loop lines attached to the sign or rail through a pair of spaced-apart openings formed in the sign or rail, each loop line comprising a pair of side by side cords of equal length having a proximal end and a distal end joined together by knots at equal intervals along their length from the proximal end to the distal end to form a plurality of equispaced knots defining equispaced loops of equal length separated by the knots along their lengths, comprising inserting the lower proximal end of each loop line through a said opening in the sign or rail, passing the distal end of each loop line through a loop at the lower proximal end adjacent the proximal end to form a hitch attached to the sign or rail, counting an equal number of knots from the hitch formed on the lower proximal end of each loop line, and attaching a loop at the upper distal end of each loop line at an equal number of knots-counted from the hitches formed on the lower proximal ends to ceiling attachment means, whereby the sign or rail hangs level.

5. A method as claimed in claim 4, in which said cords are monofilament or are string or thin rope made of several strands braided, twisted or woven together.

6. A method as claimed in claim 5, in which the knots for joining the cords together are formed by tying or by interlacing, braiding or looping the cords and are upset from the loop whereby a user can feel the knots for counting the knots during installation.

7. A method as claimed in claim 6, in which the strands are at least one of polymer, polyester or metal wire fibres.

8. A method as claimed in claim 7, in which the ceiling supports are magnet anchors each having a split ring for receiving the loop line.

* * * * *